US010842341B1

(12) United States Patent
Costello

(10) Patent No.: US 10,842,341 B1
(45) Date of Patent: Nov. 24, 2020

(54) HAIR COLLECTING DEVICE

(71) Applicant: Jacob Costello, Argyle, WI (US)

(72) Inventor: Jacob Costello, Argyle, WI (US)

( * ) Notice: Subject to any disclaimer, the term of this patent is extended or adjusted under 35 U.S.C. 154(b) by 0 days.

(21) Appl. No.: 16/944,889

(22) Filed: Jul. 31, 2020

Related U.S. Application Data

(60) Provisional application No. 62/912,236, filed on Oct. 8, 2019.

(51) Int. Cl.
*A47L 13/12* (2006.01)
*A47L 13/42* (2006.01)

(52) U.S. Cl.
CPC ..... *A47L 13/12* (2013.01); *A47L 13/42* (2013.01)

(58) Field of Classification Search
CPC ..... A47L 13/12; A47L 13/42
See application file for complete search history.

(56) References Cited

U.S. PATENT DOCUMENTS

| | | | |
|---|---|---|---|
| 7,020,926 | B2 | 4/2006 | McKay |
| 7,621,234 | B2 | 11/2009 | Roy |
| 7,856,690 | B2 | 12/2010 | Tuman et al. |
| 8,490,236 | B2 | 7/2013 | Ross |
| 8,590,094 | B2 | 11/2013 | Ross |

*Primary Examiner* — Andrew A Horton
(74) *Attorney, Agent, or Firm* — Boudwin Intellectual Property; Daniel Boudwin

(57) ABSTRACT

A hair collecting device is provided. The hair collecting device has a spherical body having a pair of handles extending from opposing sides thereof. The spherical body has a hair-collecting mechanism, such as an arcuate fin, extending outward from an exterior surface of the spherical body. The arcuate fin has a plurality of cutouts disposed along a length thereof that trap hairs within the cutouts. The hair collecting device also has a housing with a hingedly attached access lid defining a housing interior volume. The housing also has a notch disposed on a side of the housing. The housing interior volume is sized to receive the spherical body and the notch receives a handle of the spherical body therethrough. The housing retains the spherical body and allows the spherical body to spin about an axis defined by the pair of handles.

20 Claims, 3 Drawing Sheets

HAIR COLLECTING DEVICE

CROSS REFERENCE TO RELATED APPLICATIONS

This application claims the benefit of U.S. Provisional Application No. 62/912,236 filed on Oct. 8, 2019. The above identified patent application is herein incorporated by reference in its entirety to provide continuity of disclosure.

BACKGROUND OF THE INVENTION

The present invention relates to bathroom accessories. More particularly, the present invention provides for a device that can be secured in a bathroom that aids a user in collecting loose hairs such that the hairs are not washed down a drain or accumulate on a surface such as a wall or an area around the drain.

Many people groom their hair while in the bathroom, either while in a bathtub, a shower, or while standing over a sink. Often, such individuals will lose strands of their hair in the normal course of grooming. Commonly, this hair is gathered and is placed onto the walls of the shower or will collect inside the drain. Such an accumulation of hair in the drain can form a clog which can cause the drain to overflow as well as potentially damaging the pipes. Showers typically do not have a mechanism to clear such a clog and a professional plumber must be called out to eliminate the clog and/or fix the pipes. In some cases, the hair can also accumulate around the drain and surrounding surfaces leaving an unsightly mass.

Devices have been disclosed in the known art that relate to bathroom accessories. These include devices that have been patented and disclosed in patent application publications. However, the devices in the known art have several drawbacks. Some people purchase dangerous chemicals and pour them down the drain in an attempt to clear the clog. Some of these chemicals can in fact damage the drain and pipes. Additionally, noxious and toxic fumes may emanate as the chemicals interact with the clog. Such fumes can be harmful to a person breathing them in and should be avoided. Some people place filters or covers over the drain in order to capture the hair, but these devices often interfere with the flow of the water down the drain causing water to accumulate during a shower. Such devices can also be difficult to clean and may begin to accumulate mold and bacteria if not sanitized often.

The present invention substantially diverges in design elements from the known art and consequently it is clear that there is a need in the art for an improvement to existing bathroom accessories. In this regard the present invention substantially fulfills these needs.

SUMMARY OF THE INVENTION

In view of the foregoing disadvantages inherent in the known types of bathroom accessories now present in the art, the present invention provides a hair collecting device wherein the same can be secured in a bathroom and that can aid a user in collecting loose hairs such that the hairs are not washed down a drain or accumulate on a surface such as a wall or an area around the drain. The present hair collecting device comprises a spherical body having a pair of handles extending from opposing sides thereof. The spherical body has a hair-collecting mechanism, such as an arcuate fin, extending outward from an exterior surface of the spherical body. The arcuate fin has a plurality of cutouts disposed along a length thereof that trap hairs within the cutouts. The hair collecting device also has a housing with a hingedly attached access lid defining a housing interior volume. The housing also has a notch disposed on a side of the housing. The housing interior volume is sized to receive the spherical body and the notch receives a handle of the spherical body therethrough. The housing retains the spherical body and allows the spherical body to spin about an axis defined by the pair of handles.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
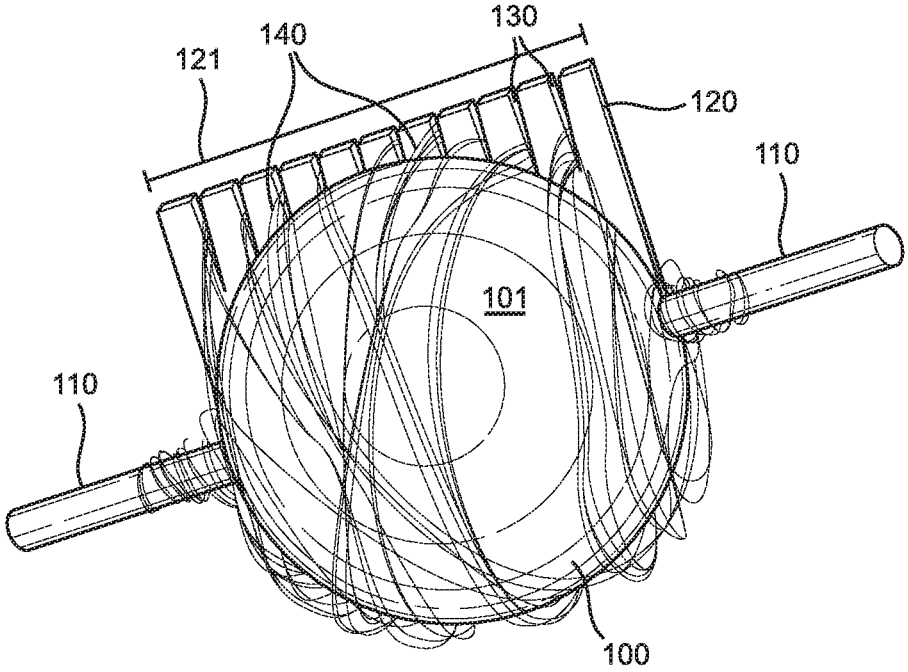
FIG. 1A shows a close-up view of a spherical body in an embodiment of the hair collecting device.

Reference is made herein to the attached drawings. Like reference numerals are used throughout the drawings to depict like or similar elements of the hair collecting device. For the purposes of presenting a brief and clear description of the present invention, a preferred embodiment will be discussed as used for the hair collecting device. The figures are intended for representative purposes only and should not be considered to be limiting in any respect.

Figure 2:
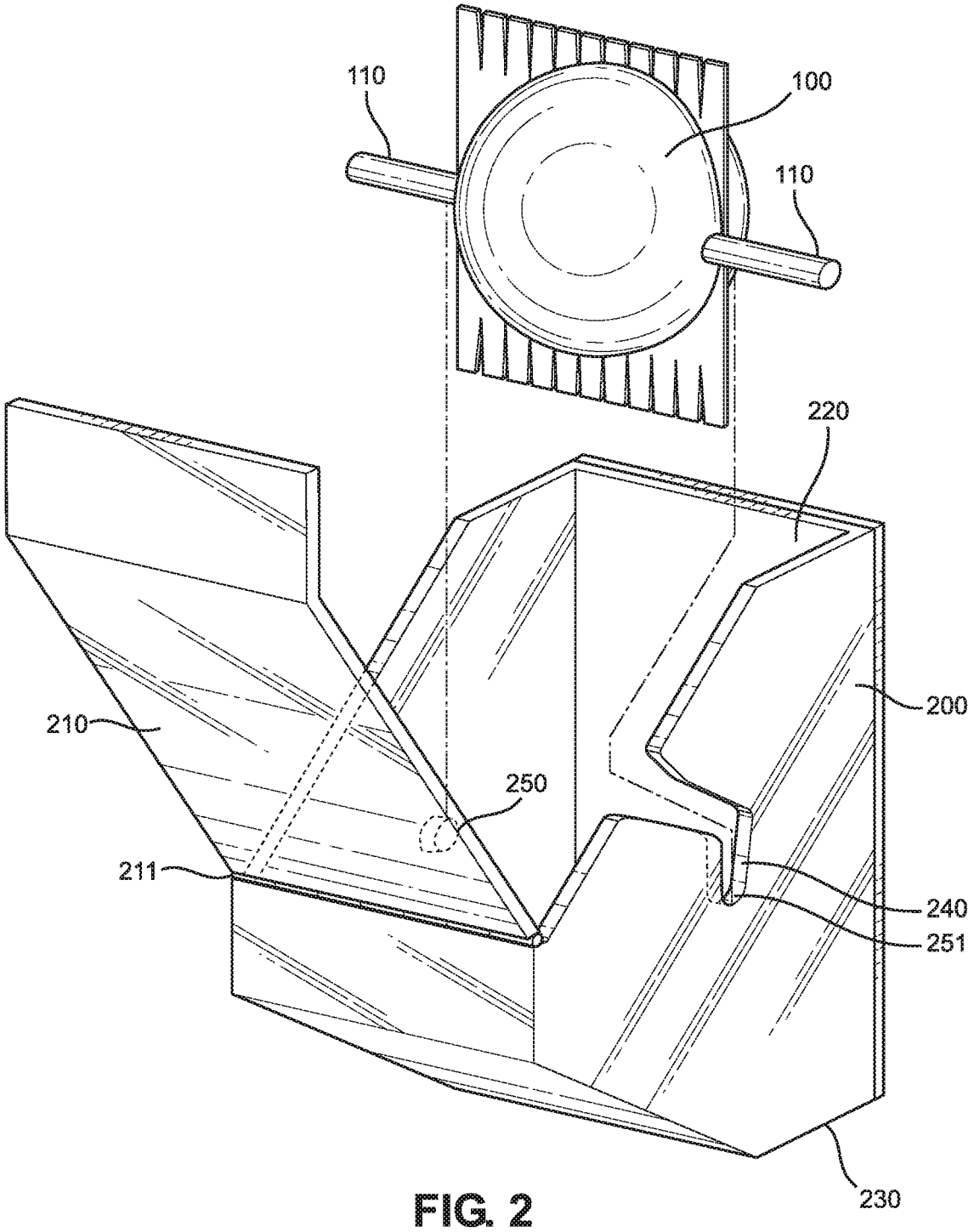
FIG. 2 shows an exploded view of an embodiment of the hair collecting device.

Referring now to FIG. 1A, there is shown a close-up view of a spherical body in an embodiment of the hair collecting device. The hair collecting device comprises a spherical body 100 having a pair of handles 110 extending from opposing sides of the spherical body 100. In the shown embodiment, the pair of handles 110 are cylindrical and are thereby able to rotate within a notch or aperture of a housing (as shown in FIG. 2). The handles 110 enable a user to pick up and transport the spherical body 100 without touching the spherical body 100 itself. The handles 100 also define an axis about which the spherical body 100 can turn.

The spherical body 100 further comprises a fin 120 extending outwardly from an exterior surface 101 of the spherical body 100. In the shown embodiment, the fin 120 has an arcuate lower end and a linear upper end. The arcuate lower end mimics a contour of the spherical body 100 such that the lower end can rest flush against the exterior surface 101 of the spherical body 100. In the shown embodiment, the fin 120 is disposed along the axis defined by the handles 110 and extends from one handle 110 to the opposing handle 110. Further, in the shown embodiment, the fin 120 is planar. In such a manner, a length 121 of the fin 120 rotates about the axis defined by the handles and is able to provide a maximum amount of surface area when so rotated. In various embodiments, a distal end of the fin 120 is linear whereas a base of the fin 120 is arcuate in order to mimic the contours of the spherical body 100.

The fin 120 further comprises a plurality of cutouts 130 disposed along the length 121 thereof. In the shown embodiment, the cutouts 130 are "V" shaped in order to provide a channel into which a single hair 140, or multiple hairs 140 can become trapped. It is an object of the present invention to receive and trap hair 140 on the spherical body 100 and the fin 120, as well as inside the cutouts 130, and along the handles 110, in order to prevent the hair 140 or multiple hairs 140 from forming a clog in a drain or from forming an undesirable and unclean mess on a surface such as an area surrounding the drain or sink. As hair 140 is deposited on the spherical body 110, the spherical body 110 can rotate to entangle the hair 140. The hair 140 can also become entangled along the handles 110 and can get wedged within the cutouts 130. In the shown embodiment, the central cutouts 130 are less deep than the cutouts 130 proximal to the ends of the spherical body 110.

Figure 1B:
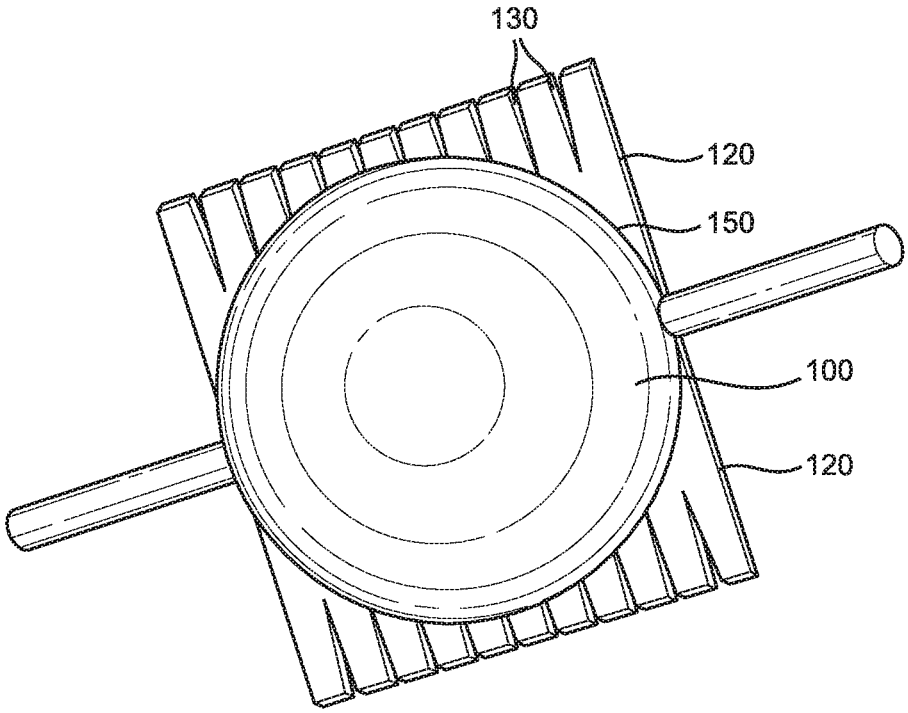
FIG. 1B shows a close-up view of a spherical body in an alternate embodiment of the hair collecting device.

Referring now to FIG. 1B, there is shown a close-up view of a spherical body in an alternate embodiment of the hair collecting device. In the shown embodiment, the spherical body 100 further comprises a pair of fins 120 disposed opposite each other and extending outwardly from an equator 150 of the spherical body 100. The presence of a pair of fins 120 increases the surface area of the fins 120 relative to the spherical body 100 and provides a greater number of cutouts 130 into which hair can become trapped and/or entangled resulting in the device having a larger capacity for holding said hair. In the shown embodiment, the pair of fins 120 are disposed along a plane defined by the equator 150, thereby providing a unitary planar pair of fins 120. In some embodiments, instead of a pair of fins 120, a single ring-shaped fin 120 can be disposed about the equator 150 of the spherical body 100.

Figure 1C:
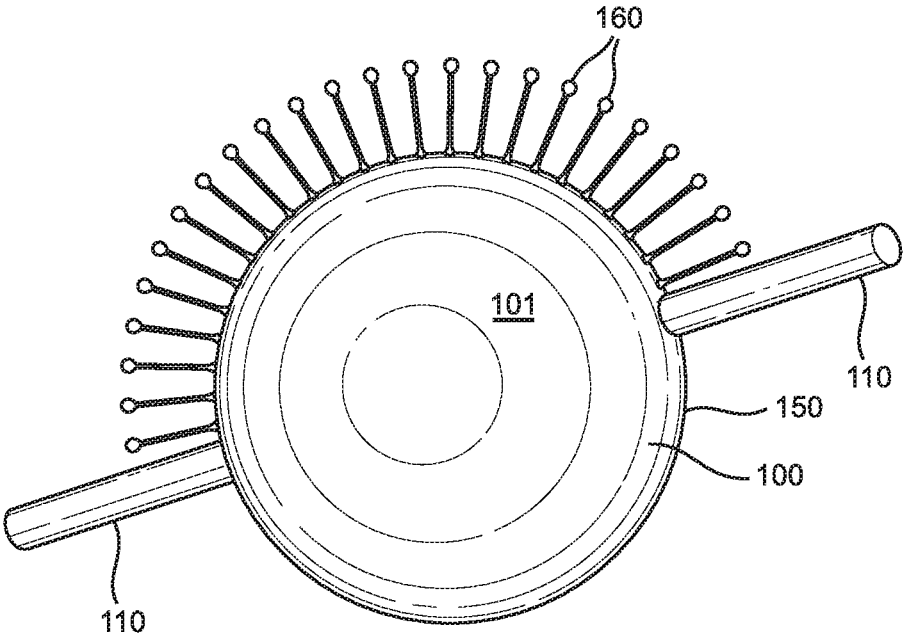
FIG. 1C shows a close-up view of a spherical body in an alternate embodiment of the hair collecting device.

Referring now to FIG. 1C, there is shown a close-up view of a spherical body in an alternate embodiment of the hair collecting device. In the shown embodiment, the spherical body 100 further comprises a plurality of bristles 160 extending outwardly from the exterior surface 101 of the spherical body 100. In the shown embodiment, the bristles 160 are disposed along a top half of the plane defined by the equator 150. In another embodiment, the bristles 160 are disposed along the entire equator 150. Similar to the fins, the bristles 160 are configured to entangle and trap individual or multiple hairs along the bristles 160 in order to prevent the hair from collecting on a surface or gathering in a drain. Similar to the embodiment shown in FIGS. 1A and 18, in the shown embodiment, the bristles 160 are disposed along the axis defined by the handles 110 and extends from one handle 110 to the opposing handle 110. In the shown embodiment, the bristles 160 are equivalent lengths, and are angled relative to a curvature of the spherical body 110. Further, in the shown embodiment, each of the bristles 160 include a bulbous terminal end to aid in securing the hair.

Referring now to FIG. 2, there is shown an exploded view of an embodiment of the hair collecting device. The hair collecting device further comprises a housing 200 with an access lid 210 that is attached to the housing 200 by a hinge 211, thereby defining a housing interior volume 220. The housing interior volume 220 is sized to receive the spherical body 100 such that the spherical body 100 is free to rotate therein. In the shown embodiment, the housing 200 further comprises an open bottom end 230. In one embodiment, the housing 200 can be mounted to a desired surface such as a shower wall by fasteners disposed on a rear surface of the housing 200. In a further embodiment, the fasteners are peel and stick adhesive fasteners that enable to the housing 200 to be removably secured to the surface without damaging the surface. When the housing 200 is thus secured to the surface, the open bottom end 230 can be positioned such that water from a shower or other source of water, such as a user's wet hands, can flow through the open bottom end 230 and prevent the collection of said water in the housing 200.

In the shown embodiment, the housing 200 further comprises a notch 240 disposed on a side of the housing 200. The notch 240 is configured to receive a single handle 110 of the pair of handles 110 therethrough. In this manner, the spherical body 100 can be easily inserted and removed into the housing 200. The housing 200 is also configured to allow the spherical body 100 to spin about an axis defined by the pair of handles 110. In this manner, the spherical body 100 can be secured within the interior volume 220 and can spin therein, while the handle 110 extends through the housing 200 and the handle can spin within the notch 240. Thus, in one embodiment, the notch 240 is configured to enable the handle 210 to rotate freely within the notch 240 along an axis defined by the pair of handles 110. In the shown embodiment, an aperture 250 is disposed on an opposing side of the housing 200 from the notch 240, wherein the aperture 250 is sized to receive a distal end of the handle 110 therethrough. The aperture 250 serves to further secure the handles 110 such that the spherical body 100 can spin unencumbered when secured within the interior volume 220. In the shown embodiment, the aperture 250 is disposed opposite a terminal point 251 of the notch 240, such that when the handles 110 of the spherical body 100 are received by the aperture 250 and the notch 240, the spherical body 100 is held level.

In use, a user can gather hair while in the shower, or similarly grooming themself. The hair can then be manually placed onto the spherical body 110 and either run against the fin, or thread through the cutouts in order to transplant the hair from the user's hand to the hair collecting device. The spherical body 100, and cutouts, are configured to provide an easy manner in which the hair can be transferred. As hair, and especially wet hair, has a tendency to adhere to the user's hands, such components provide a surface onto which the hair can be deposited. The spherical body 100 can then be rotated in the housing 200 to further secure the hair to the hair collecting device by entangling or threading the hair in the cutouts, along the handles 110, and atop the spherical body 100. The spherical body 100 can also be rotated to provide a new surface of the spherical body 100 when a given portion of the spherical body 100 is already covered in hair. Excess water can flow or drip out of the open end 230 of the housing 200 such that water does not accumulate therein. The lid 210 can then be moved to a closed position such that the hair within the hair collecting device does not wash off of the spherical body 100 and surrounding components. As the spherical body 100 and handles 110 become entangled with hair, the spherical body 100 can be removed from the housing 200 in order to be cleaned off or replaced.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair collecting device, comprising:

a spherical body having a pair of handles extending from opposing sides of the spherical body;

the spherical body further comprising a fin extending outward from an exterior surface of the spherical body;

the fin further comprising a plurality of cutouts disposed along a length thereof;

a housing having a hingedly attached access lid defining a housing interior volume;

the housing interior volume sized to receive the spherical body;

the housing further comprising a notch disposed on a side of the housing;

the notch configured to receive a single handle of the pair of handles therethrough; and the housing configured to allow the spherical body to spin about an axis defined by the pair of handles.

2. The hair collecting device of claim 1, wherein each of the pair of handles are cylindrical.

3. The hair collecting device of claim 1, wherein the fin is planar.

4. The hair collecting device of claim 1, further comprising an aperture disposed on an opposing side of the housing from the notch, wherein the aperture is sized to receive a distal end of the handle therethrough.

5. The hair collecting device of claim 4, wherein the aperture is disposed opposite a terminal point of the notch, such that when the handles of the spherical body are received by the aperture and the notch, the spherical body is held level.

6. The hair collecting device of claim 1, wherein the notch is configured to enable a first handle of the pair of handles to rotate freely within the notch along an axis defined by the pair of handles.

7. The hair collecting device of claim 1, wherein the cutouts are "V" shaped.

8. The hair collecting device of claim 1, wherein fasteners are disposed on a rear surface of the housing.

9. A hair collecting device, comprising:

a spherical body having a pair of handles extending from opposing sides of the spherical body;

the spherical body further comprising a pair of fins disposed opposite each other and extending outward from an equator of the spherical body;

each of the pair of fins further comprising a plurality of cutouts disposed along a length thereof;

a housing having a hingedly attached access lid defining a housing interior volume;

the housing further comprising a notch disposed on a side of the housing;

the housing interior volume sized to receive the spherical body;

the notch configured to receive a single handle of the pair of handles therethrough; and the housing configured to allow the spherical body to spin about an axis defined by the pair of handles.

10. The hair collecting device of claim 9, wherein the cutouts are "V" shaped.

11. The hair collecting device of claim 9, wherein each of the pair of handles are cylindrical.

12. The hair collecting device of claim 9, further comprising an aperture disposed on an opposing side of the housing from the notch, wherein the aperture is sized to receive a distal end of the handle therethrough.

13. The hair collecting device of claim 12, wherein the aperture is disposed opposite a terminal point of the notch, such that when the handles of the spherical body are received by the aperture and the notch, the spherical body is held level.

14. The hair collecting device of claim 9, wherein the notch is configured to enable a first handle of the pair of handles to rotate freely within the notch along an axis defined by the pair of handles.

15. The hair collecting device of claim 9, wherein fasteners are disposed on a rear surface of the housing.

16. A hair collecting device, comprising:

a spherical body having a pair of handles extending from opposing sides of the spherical body;

the spherical body further comprising a plurality of bristles extending outward from an exterior surface of the spherical body;

a housing having a hingedly attached access lid defining a housing interior volume;

the housing further comprising a notch disposed on a side of the housing;

the housing interior volume sized to receive the spherical body;

the notch configured to receive a single handle of the pair of handles therethrough; and the housing configured to allow the spherical body to spin about an axis defined by the pair of handles.

17. The hair collecting device of claim 16, further comprising an aperture disposed on an opposing side of the housing from the notch, wherein the aperture is sized to receive a distal end of the handle therethrough.

18. The hair collecting device of claim 17, wherein the aperture is disposed opposite a terminal point of the notch, such that when the handles of the spherical body are received by the aperture and the notch, the spherical body is held level.

19. The hair collecting device of claim 16, wherein the notch is configured to enable a first handle of the pair of handles to rotate freely within the notch along an axis defined by the pair of handles.

20. The hair collecting device of claim 16, wherein fasteners are disposed on a rear surface of the housing.

* * * * *